US012577490B2

(12) United States Patent
Osichow et al.

(10) Patent No.: US 12,577,490 B2
(45) Date of Patent: Mar. 17, 2026

(54) ANTIFRICTION COATINGS AND METHODS OF MAKING ANTIFRICTION COATINGS

(71) Applicant: DDP SPECIALTY ELECTRONIC MATERIALS US, LLC, Wilmington, DE (US)

(72) Inventors: Anna Osichow, Wiesbaden (DE); Marita Barth, Wiesbaden (DE); Jochen Busch, Braunfels (DE)

(73) Assignee: DDP SPECIALTY ELECTRONIC MATERIALS US, LLC

( * ) Notice: Subject to any disclaimer, the term of this patent is extended or adjusted under 35 U.S.C. 154(b) by 0 days.

(21) Appl. No.: 18/699,387

(22) PCT Filed: Aug. 26, 2022

(86) PCT No.: PCT/US2022/041707

§ 371 (c)(1),
(2) Date: Apr. 8, 2024

(87) PCT Pub. No.: WO2023/059407

PCT Pub. Date: Apr. 13, 2023

(65) Prior Publication Data

US 2024/0327741 A1 Oct. 3, 2024

Related U.S. Application Data

(60) Provisional application No. 63/253,624, filed on Oct. 8, 2021.

(51) Int. Cl.
*C10M 103/02* (2006.01)
*C10M 103/06* (2006.01)
(Continued)

(52) U.S. Cl.
CPC ..... *C10M 103/02* (2013.01); *C10M 103/06* (2013.01); *C10M 177/00* (2013.01);
(Continued)

(58) Field of Classification Search
CPC ..... C10N 2050/02; C10N 2070/00; C10N 2020/06; C10M 103/02; C10M 177/00;
(Continued)

(56) References Cited

U.S. PATENT DOCUMENTS

2015/0057199 A1 2/2015 Yamasaki et al.
2016/0281021 A1 9/2016 Schiff-Deb et al.

FOREIGN PATENT DOCUMENTS

CN 1621464 A * 6/2005
KR 102014936 B1 * 10/2019

* cited by examiner

*Primary Examiner* — Vishal V Vasisth
(74) *Attorney, Agent, or Firm* — Matthew T. Fewkes

(57) ABSTRACT

A method of making an antifriction coating composition, comprising the steps of (A) combining (i) a solid lubricant, (ii) a solvent, (iii) a binder, and (iv) optionally, an additive; and (B) grinding the (i) solid lubricant in the solvent (ii) with a basket mill for sufficient time to form a dispersion of the ground (i) solid lubricant in the (ii) solvent, and wherein the binder (iii) and the optional additive (iv) are each independently combined with the solid lubricant (i) and solvent (ii) before, during, after, or a combination of two or more of before, during, and after, (B).

10 Claims, 3 Drawing Sheets

(51) Int. Cl.
*C10M 177/00* (2006.01)
*C10N 50/02* (2006.01)
*C10N 70/00* (2006.01)

(52) U.S. Cl.
CPC ..... *C10M 2201/0413* (2013.01); *C10M 2201/0663* (2013.01); *C10N 2050/02* (2013.01); *C10N 2070/00* (2013.01)

(58) Field of Classification Search
CPC ..... C10M 103/06; C10M 2205/163; C10M 2201/0663; C10M 2201/0413; C10M 2213/0623; C10M 2205/143; C10M 2205/183; C10M 2229/025
See application file for complete search history.

ANTIFRICTION COATINGS AND METHODS OF MAKING ANTIFRICTION COATINGS

CROSS-REFERENCE TO RELATED APPLICATIONS

This application is a U.S. national stage filing under 35 U.S.C. § 371 of PCT Application No. PCT/US2022/041707 filed on Aug. 26, 2022, which claims priority to U.S. provisional patent application No. 63/253,624 filed on Oct. 8, 2021, each of which is incorporated herein by reference in its entirety.

FIELD OF THE INVENTION

The invention generally relates to the field of antifriction coating compositions comprising a binder, solid lubricant, a solvent and any other ancillary additives, methods of making antifriction coating compositions, antifriction coatings made from the antifriction coating compositions, and parts coated with antifriction coatings.

BACKGROUND OF THE INVENTION

Anti-friction coatings (AFC), also known as bonded lubricants, are used to reduce friction, wear, and noise in many applications. AFCs are typically created by applying an AFC composition to a substrate and then subjecting the AFC composition to curing process to form the AFC. The AFC compositions are typically a dispersion consisting of a binder, which is usually a polymer resin, solid lubricants, solvents and other additives. The antifriction coating composition is applied to a substrate by conventional application techniques. For example, the AFC composition may be applied by brushing, dipping, dip-spinning, and spraying. The typical coating thickness is from 5 to 20 μm.

Antifriction coating performance can be determined by observation under microscope to identify coating coverage and by measuring load carrying capacity and product life time using a linear oscillation friction test where a load is increased or kept constant until coating failure.

To achieve the 5 to 20 μm coating thickness and enable use in the spray application methods, grinding of the solids in the AFC composition is required as a manufacturing step. The grinding is typically conducted using a bead mill, which can be used to process ultra-fine solids in liquids with a particle size range from about 500 μm maximum down to the submicron (nanometer) range. Depending on the product properties, various types of agitator bead mills with different grinding systems may be employed. The grinding step with the bead mill is the most expensive manufacturing step in the AFC production.

The bead mill grinding step is expensive because the machines are technically demanding and difficult to clean, and the peripherals, such as pumps, hoses, and stirrers, must also be cleaned. The difficulty in cleaning forces the isolation of the bead mill grinders for use with only a single AFC product or AFC product family. Additional costs associated with the bead mill grinding process include that two containers are needed to prepare the AFC compositions (one to pre-disperse solids and a second to receive the grinded product from the bead mill), and that the low viscosity AFC compositions ground cause abrasive wear on the bead mill chamber requiring frequent equipment replacement. Finally, the bead mills used to make AFC compositions typically are not efficient, with multiple passes through the bead mill required to achieve the desired particle size and with particle size and distribution being difficult to control.

There is a need for more efficient processes for producing AFC compositions with reduced manufacturing time, and which use equipment that is easier to clean, dispersed and grind solids in the same vessel, is usable across multiple products or product families, and requires replacement less frequently due to wear. Further, there is also a need for processes for producing AFC compositions that allow for more control over the particle size and particle size distribution of the ground solids. Finally, there is a need for AFCs with improved performance for load carrying capacity and product life time.

BRIEF SUMMARY OF THE INVENTION

The present invention is directed to a process of making an antifriction coating composition, comprising the steps of (A) combining (i) a solid lubricant, (ii) a solvent, (iii) a binder, and (iv) optionally, an additive; and (B) grinding the (i) solid lubricant in the solvent (ii) with a basket mill for sufficient time to form a dispersion of the ground (i) solid lubricant in the (ii) solvent, and wherein the binder (iii) and the optional additive (iv) are each independently combined with the solid lubricant (i) and solvent (ii) before, during, after, or a combination of two or more of before, during, and after, (B).

The present invention is further directed to an antifriction coating composition, comprising s dispersion of (i) a solid lubricant; (ii) a solvent, (iii) a binder, and (iv) optionally, an additive, wherein the binder and solid lubricant have a particle size (d90) up to 50 μm and (d50) of up to 25 μm.

The process of the invention provides a more efficient process for making AFC compositions, reduced manufacturing times, and uses equipment that is easier to clean, that disperses and grinds solids in the same vessel, that is usable across multiple products or product families, and that requires replacement less frequently due to wear. Further, the process allows for more control over the particle size of the ground solids in AFC compositions, and produces AFC compositions having improved performance for load carrying capacity and product life time.

DETAILED DESCRIPTION OF THE INVENTION

Figure 1:
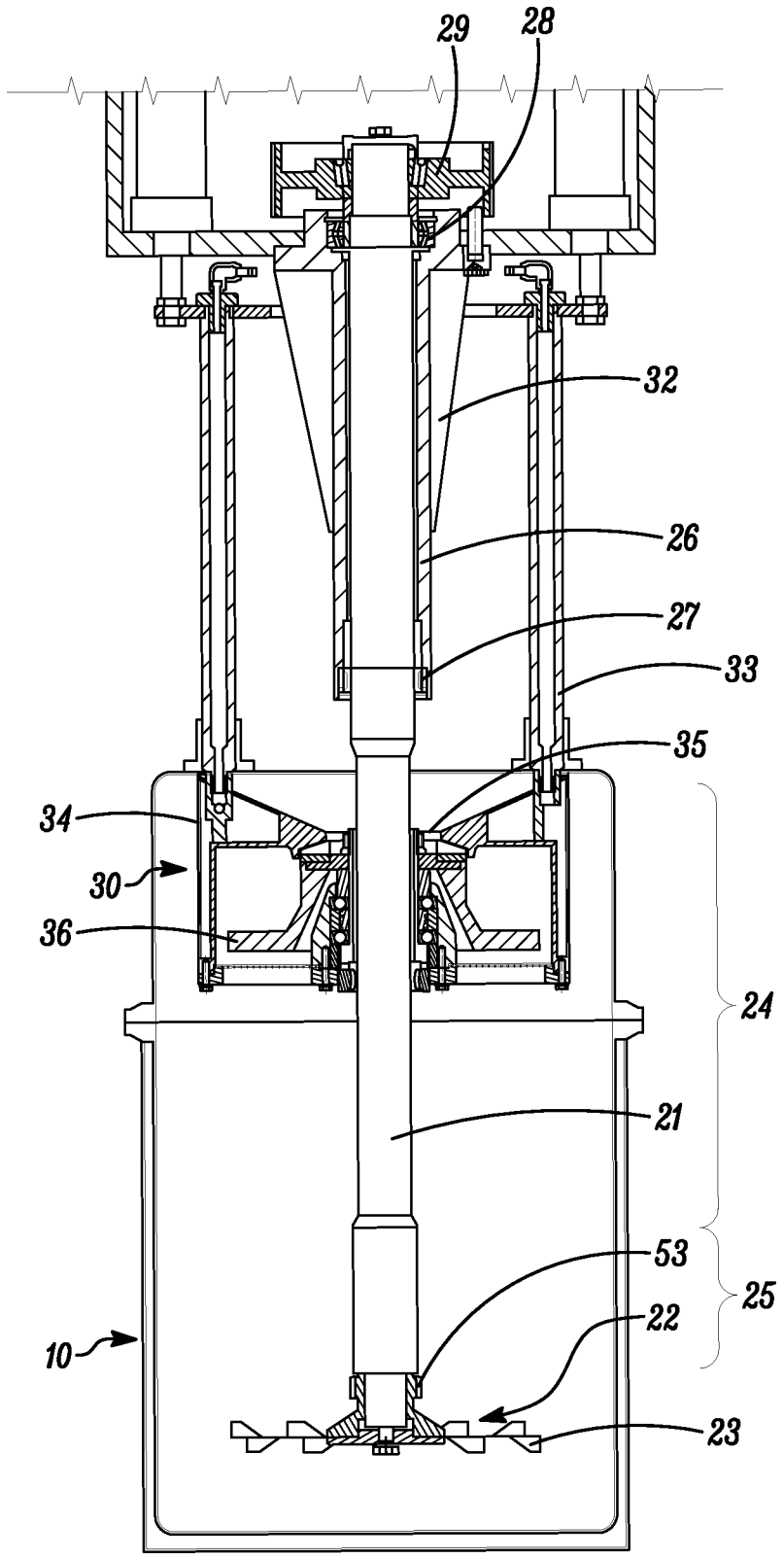
FIG. 1 shows a view in cross-section through a basket mill used according to the invention.

As used herein, the term "AFC composition" refers to an uncured composition comprising a solvent.

As used herein, the term "AFC" refers to a coating resulting from the application of an AFC composition to a substrate and the removal of solvent from and/or the curing of AFC composition on the substrate.

As used herein, the articles "a" and "an" are not limiting and should be interpreted to include one or more when describing an element of the invention.

A method of making an antifriction coating composition, comprising the steps of:

(A) combining (i) a solid lubricant,
(ii) a solvent,
(iii) a binder,
(iv) optionally, an additive; and (B) grinding the (i) solid lubricant in the solvent (ii) with a basket mill for sufficient time to form a dispersion of the ground (i) solid lubricant in the (ii) solvent, and wherein the binder (iii) and the optional additive (iv) are each independently combined with the solid lubricant (i) and solvent (ii) before, during, after, or a combination of two or more of before, during, and after, (B).

The solid lubricant (i), the solvent (ii), the binder (iii), and, optionally, the additive are combined. The solid lubricant may be any solid lubricant or mixture of solid lubricants known for use in AFCs. Examples of solid lubricants include, but are not limited to, graphite, $MoS_2$, polytetrafluoroethylene (PTFE), silicone, zinc sulfide, tricalcium phosphate, wax, a solid hydrocarbon wax such as a polyolefin wax (polypropylene wax, polyethylene wax, polyamide wax) or a mixture of two or more of PTFE, polyolefin wax, molybdenum disulfide, graphite, zinc sulfide or tricalcium phosphate. One skilled in the art would know solid lubricants suitable for AFC compositions and how to select a solid lubricant. Solid lubricants are available commercially.

The solvent may be any solvent or mixture of solvents typically used in AFC compositions, and is typically selected to be a solvent for the binder. The solid lubricant, pigments, and any other ingredients may not be, and typically are not, soluble in the solvent. Examples of the solvent include, but are not limited to, water, alcohols (e.g. methanol, ethanol, propanol, butanol), ketones (e.g. acetone, methyl ethyl ketone, methyl butyl ketone, cyclohexanone), ester (e.g. butyl acetate), aliphatic hydrocarbons, heterocyclic (e.g. N-methylpyrrolidone) and non-heterocyclic aromatic solvents (e.g. toluene, xylene), including mixtures of two or more thereof. Alternatively, the solvent is a mixture of alcohols and esters, in a ratio of alcohol to ester from 10:90 to 50:50 (w/w). Alternatively, the solvent is any suitable combination of alcohols, esters and ketones, alternatively a mixture of butyl acetate, ethanol and methyl ethyl ketone. One skilled in the art would know how to select a solvent to combine in the AFC. Suitable solvents are available commercially.

The binder may be any binder or mixture of binders suitable for use in AFCs. Examples of binders include, but are not limited to, resins including phenolic resin, epoxy resin, polyvinyl butyral, styrene maleic anhydride (SMA) copolymers, polyvinyl acetate, polymeric butyl titanate, urea-formaldehyde resin, polyamide imide, and silicone resin, or mixtures of two or more of a phenolic resin, an epoxy resin, a polyvinyl butyral, a styrene maleic anhydride (SMA) copolymers, a polyvinyl acetate, polymeric butyl titanate, urea-formaldehyde resin, a polyamide imide, and a silicone resin. One skilled in the art would know how to select a binder for an antifriction coating. Suitable binders are available commercially.

The optional additive may be one or more additives, and the optional additive include any other materials typically used in AFCs but that are not required in the AFC. Examples of optional additives include, but are not limited to, catalysts, pigments, surface tension additives, coupling agents, and thickeners. Any suitable catalysts that are typically used in AFCs may be included in the AFC. Examples of suitable catalysts include, but are not limited to, catalysts for this purpose include, phosphoric acid and phenolsulfonic acid. The catalyst will affect the curing rate of the AFC composition to form the AFC. One skilled in the art would know how to select a suitable catalyst for the materials of the AFC composition. Suitable catalysts are available commercially.

Any pigment that is suitable for use with the ingredients of the AFC may be combined. Examples of suitable pigments include, but are not limited to, calcium fluoride ($CaF_2$), carbon black, aluminium trioxide ($Al_2O_3$), Silicon carbide (SiC), antimony trioxide, silicon nitride ($SiN_4$), titanium carbide (TIC), titanium oxide ($TiO_2$), silicon oxide ($SiO_2$), talc and other appropriate inorganic powders and mixtures thereof. Other pigments which may be utilized include melamine cyanurate (alone or mixed with a micronized amide wax, polyamide-12 polymer, polyetheretherketone polymers as well as mixtures thereof and with the inorganic materials listed above. One skilled in the art would know how to select a suitable pigment or mixture of pigments. Pigments suitable for use in AFCs are available commercially.

Any surface tension additive that is suitable for use with the ingredients of the AFC may be combined. Surface tension additives are added typically to improve the wetting of the coated parts. Examples of suitable surface tension additives include, but are not limited to, silicone glycols, polyester-modified polydimethylsiloxane. One skilled in the art would know how to select a suitable surface tension additive. Surface tension additives suitable for use in AFCs are available commercially.

Any coupling agent that is suitable for use with the ingredients of the AFC may be combined. Coupling agent additives are added to improve the adhesion of the AFC with the substrate and cohesion of the binder and solid lubricants. Examples of suitable coupling agents include, but are not limited to, silanes, such as methyltrimethoxysilane, 1,6-bis (trimethoxysilyl) hexane, (ethylenediaminepropyl) trimethoxysilane, and (3-glycidoxypropyl) triethoxysilane. One skilled in the art would know how to select a suitable coupling agent. coupling agent suitable for use in AFCs are available commercially.

Any thickener or mixture of thickeners that are suitable for use with the ingredients of the AFC may be combined as an optional additive. Thickeners are added to modify the viscosity of the AFC composition to allow for proper application of the AFC composition to the substrate to give a desired AFC thickness. Examples of suitable thickener include, but are not limited to, a polyamide, metal soaps, silica, bentonite, and urea-based materials. One skilled in the art would know how to select a suitable thickener for use in AFCs are available commercially. Suitable thickeners are available commercially.

The solid lubricant (i) and the solvent (ii) are combined in any order prior to and/or during the grinding in (B), alternatively prior to the grinding in (B), alternatively during the grinding in (B), described below. The solid lubricant (i) and the solvent (ii) may be combining in any order in either the same vessel used for the grinding in (B) or different vessels, alternatively (i) and (ii) are combined in any order in the same vessel used for the grinding step (B), alternatively (i) and (ii) are combined by adding (ii) to a vessel first followed by adding (i) to the vessel with mixing and/or grinding, alternatively by adding (i) to a vessel followed by adding (ii) with mixing and/or grinding. When (i) and (ii) are combined prior to the grinding in (B), they may or may not be premixed prior to (B).

The combining of the binder (iii) and optional additives (iv) can vary with each being independently combined together or separately with (i) and (ii) according to methods known in the art and in any order either before, during or after the grinding in (B), alternatively the solvent (ii) is combined in the AFC composition in portions: one portion being combined with solid lubricant (i) before and/or during (B) and one portion of (ii) combined separately with (iii) to form a mixture of (ii) and (iii), where the mixture of (ii) and (iii) typically forms a solution, followed by later combining the mixture of (ii) and (iii) with the combination of (i) and (ii) after the grinding of the combination of (i) and (ii) in step (B). When (ii) is combined in portions, the mixture formed from the combination of (ii) and (iii) may be combined with the combination of (i) and (ii) either before, during, or after (B), alternatively after (B), alternatively before (B), alternatively during (B).

Methods known in the art, such as using a dissolver disc or a paddle mixer, may be used to mix (i), (ii), (iii), and (iv). One skilled in the art would know how to select a suitable mixer. Many suitable mixers are available commercially.

In one embodiment, the method further comprises combining the binder (iii) with a second solvent (v) to form a mixture and combining the mixture with the solid lubricant (i) and the solvent (ii) before, during, or after, alternatively after, (i) and (ii) have been ground in (B).

The second solvent (v) is as described above for the solvent (ii). The solvent (ii) and the second solvent (v) may be the same or different, alternatively (ii) and (v) are the same, alternatively (ii) and (v) are different. The binder and the solid lubricant are as described above.

The binder (iii) and second solvent (v) may be combined according to methods known in the art. In one embodiment (iii) and (v) are combined with mixing. Methods known in the art for mixing may be used. One skilled in the art would know how to combine (iii) and (v) and what equipment to use to mix (iii) and (v).

Figure 2:
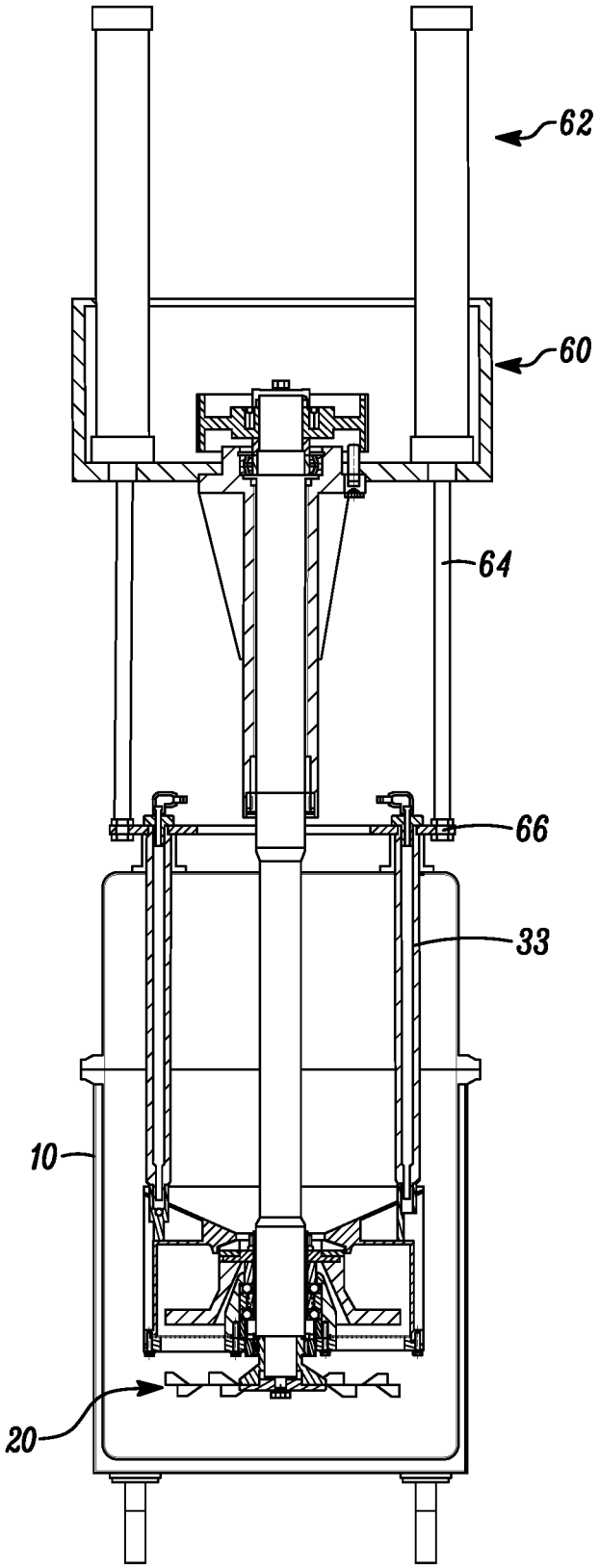
FIG. 2 shows the basket mill of FIG. 1 with the grinding device in the lowered position.
Figure 3:
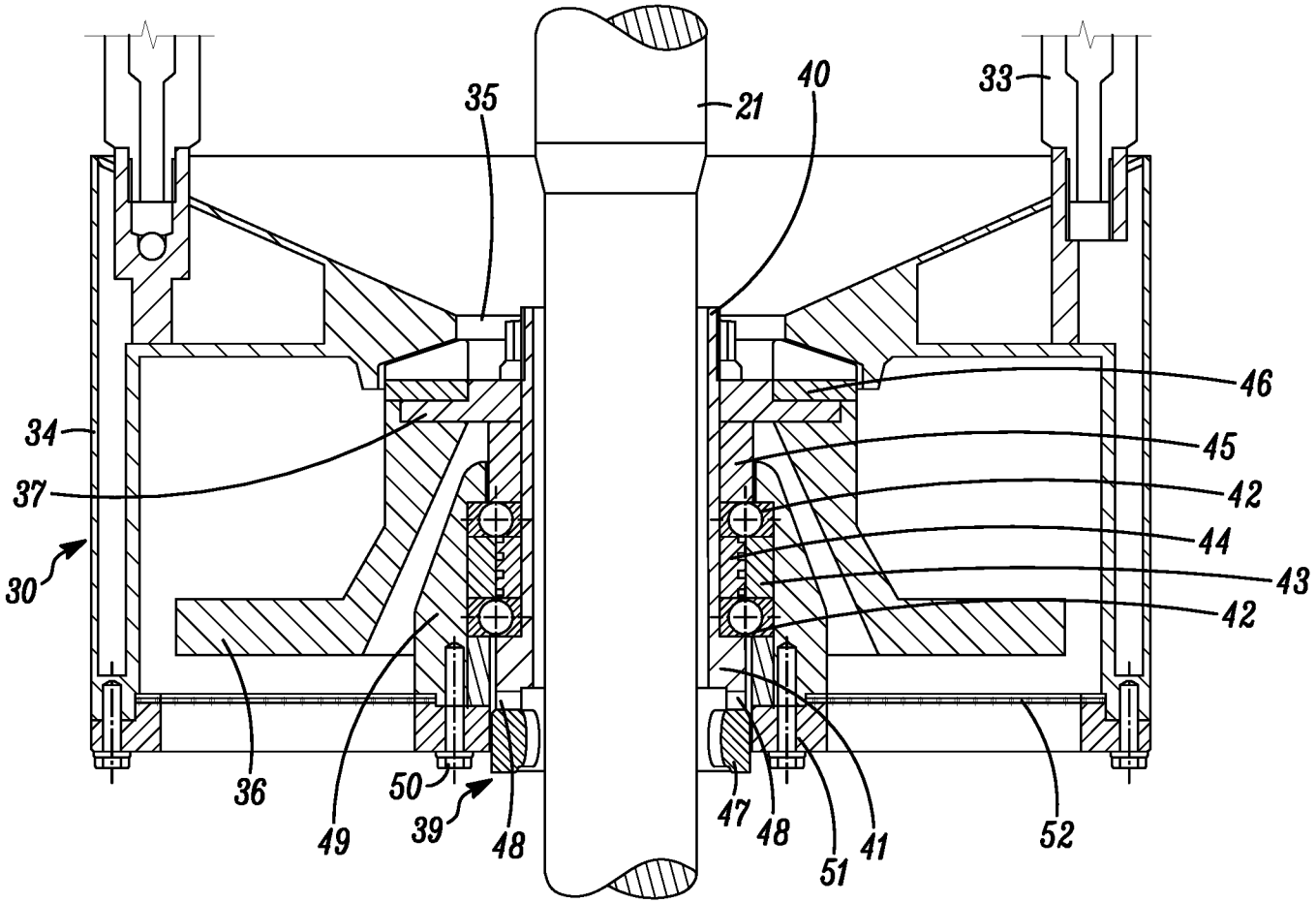
FIG. 3 shows a view on an enlarged scale in cross-section of the basket mill of FIG. 1.

The basket mill according to the invention is described with reference to FIGS. 1-3. The basket mill herein described should be considered a preferred embodiment found to function well. One skilled in the art would appreciate that many changes can be made to the basket mill specific embodiments and still obtain a like or similar result without departing from the spirit and scope of the invention, the basket mill according to the invention comprises a substantially cylindrical, double-wall container 10 which is closable with a cover, a dissolver 20 and an agitator basket mill 30. A cleaning device which is not shown in detail here can also be arranged in the container.

The dissolver 20 comprises a cylindrical shaft 21 which has a dissolver disc 22 at its lower end. The dissolver disc 22 is provided along its periphery with a plurality of teeth 23 which are bent alternately upwardly and downwardly on the circular surface. The shaft 21 has a central portion 24, of a first outside diameter, which at its lower end goes into a lower portion 25 whose outside diameter is greater than that of the central portion.

The shaft 21 is fixed by way of a cylindrical bearing flange 26 to an upper machine portion 60 which encloses the bearing flange in a box-like fashion. To guarantee the necessary stability, the bearing flange 26 preferably extends over more than a third of the total shaft length. In the present embodiment, the agitator basket mill 30 is adjustable in respect of height by way of pneumatic cylinders 62, the piston rods 64 of which are mounted to an intermediate plate 66. A plurality of hollow bars 33 extend from the underside of the intermediate plate 66 to the upper end of the agitator basket 30. By virtue of that configuration, the arrangement of the agitator basket 30 can be displaced vertically by means of the pneumatic cylinders 62; in addition, coolant can circulate in the agitator basket 30 by way of the hollow bars. Instead of the pneumatic cylinders, it is possible to use other adjustment means such as for example hydraulic cylinders or a worm drive.

The shaft 21 is supported in the bearing flange 26 by way of rolling bearings, wherein a needle bearing or roller bearing 27 is provided at the lower end of the bearing flange 26 and a double self-aligning bearing 28 at the upper end. The shaft 21 is driven in known manner by way of a belt pulley 29. To reinforce the bearing flange 26, a plurality of stiffening ribs 32 are provided at the upper end in peripherally mutually displaced relationship. The ribs 32 extend from approximately the center of the bearing flange 26 to the horizontal flange which is the upper flange in the installation position, at a continuous slope. Those stiffening ribs 32 impart a markedly higher level of stability to the bearing flange 26 in comparison with the bearing flanges known from the state of the art in order to prevent unwanted deflection of the shaft 21, in particular in the pre-dispersing operation.

The agitator basket 30 is fixed by way of a plurality of cylindrical hollow bars 33 which are peripherally spaced relative to each other to the underside of the upper machine portion 60 by way of the intermediate plate 66 so that the agitator basket 30 is adjustable in respect of height, with the upper machine portion 60, by means of the pneumatic cylinders 62. Instead of the pneumatic cylinders it is also possible to use other adjustment means such as for example hydraulic cylinders or a worm drive.

The agitator basket 30 itself comprises a housing 34 which is perforated sieve-like and in which grinding balls and/or beads (not shown) are held. At its upper end, the housing 34 is provided with a funnel which at its base has an opening 35 through which the shaft 21 passes. The housing 34 can be of a single-wall structure, a double-wall structure or can be of another suitable structure. The housing 34 forms an annular passage with the central hole 35. A bead and/or ball agitator 36 is disposed within the annular passage extending in coaxial relationship therewith.

At its upper end the bead and/or ball agitator 36 is connected by way of a ring disc 37 to a bearing block which is identified generally by reference 39. That bearing block comprises a cylindrical bush 40 which is centered on the lower shaft portion 25 in the lowered position and which at its lower end has an outwardly enlarging step 41. A double rolling bearing 42 is supported on the step 41, the bearings being spaced from each other by an outside spacer ring 43. Arranged radially inwardly from the spacer ring 43 between the bearings of the double rolling bearing 42 is a conveyor screw 44. The double rolling bearing 42 is supported at the top side relative to the underside of the ring disc 37 by way of a further spacer ring 45. A bladed impeller 46 is arranged on a radially external step of the ring disc 37 to provide an increased flow of product out of the container into the housing 34 and at the same time to prevent unwanted escape of the grinding balls out of the agitator basket mill in operation of the assembly. Provided at the lower end of the bearing block 39 beneath the step 41 of the bush 40 is the internal tooth arrangement 47 of an arcuate tooth coupling representing the first coupling element for transmission of torque from the shaft 21 to the ring disc 36. A plurality of suction bores 48 are arranged in peripherally mutually spaced relationship between the internal tooth arrangement 47 and the step 41 of the bush 40. Radially outwardly the bearings of the double rolling bearing arrangement 42 are supported against the inside of a hollow truncated cone 49 which tapers continuously from its lower cylindrical portion to its upper end and which is supported with an internal step on the upper bearing of the double rolling bearing 42.

Between the inside of the upper end of the hollow truncated cone 49, above the upper bearing, there is a gap of approximately 0.3 mm between the hollow truncated cone 49 and the second spacer ring 45. The product flow can pass through that gap during operation for cooling the bearings and preventing them from running dry. That configuration prevents the ingress of beads or grinding balls and thus also prevents the feared 'bead breakage'. The product flow flows continuously through the bearings to provide a self-cooling effect, due to the conveyor screw 44 and the suction bores 48.

The hollow truncated cone is screwed by way of a plurality of peripherally arranged screws 50 to an inner ring element of a circular disc portion 51. That disc portion 51 forms the base of the agitator basket mill 30 and accommodates a sieve 52 which extends from an inner ring element of the disc portion 51 radially outwardly to an outer ring element. The medium flows through that sieve 52 during the fine dispersing operation and separates the ground material from the beads.

Provided above the dissolver disc 22 and below the lower shaft portion 25 is an external tooth arrangement 53 forming the second coupling element. Upon downward movement of the agitator basket mill 30 out of the pre-dispersing position shown in FIG. 1 into the fine dispersing position shown in FIG. 2 the bush 40 is displaced on to the lower shaft portion 25 until the internal tooth arrangement 47 comes into engagement with the external tooth arrangement 53. The arcuate tooth coupling now transmits the shaft torque to the bead and/or ball agitator 36 for performing the fine dispersing operation.

The configuration of the upper shaft portion 24 which is of a smaller outside diameter than the lower shaft portion 25 ensures that there is a sufficient gap between the shaft 21 and the agitator basket 30 in the pre-dispersing position to prevent undesirable damage to the bush 40 due to possible lateral deflection movements of the shaft 21 during the pre-dispersing operation.

The arrangement of the coupling at the lower end of the agitator basket makes it possible to dispense with the hollow shaft found in the state of the art, but at the same time further to combine a pre-dispersing device and a fine dispersing device in one unit, wherein the change between the method steps can be effected simply by lowering the agitator basket mill within the container without the container having to be opened. Instead of a positively locking coupling, it will be appreciated that it is also possible to use a coupling involving a force-locking, or quick-connect, relationship, such as for example a plate coupling or the like. Finally, instead of rolling bearings in the bearing block, it is also possible to use plain bearings.

Basket mills are available commercially. In one embodiment, the basket mill is from VMA-Getzmann. Basket mills suitable for use with the present invention is described in U.S. Pat. Nos. 7,641,137, and 6,565,024, which are incorporated herein by reference for their description of a basket mills.

The grinding balls and/or beads held by the agitator may comprise various materials. Examples of materials that the beads comprise include, but are not limited to, $ZrO_2$, metal, glass, or a combination of $ZrO_2$, metal, and glass. During (B) the beads are agitated by the bead agitator, and the action of the beads performs grinding of the solid lubricant (i).

The grinding balls and/or beads are substantially spherical. The diameter of the beads can vary, alternatively the diameter of the beads is up to 5 mm, alternatively from 0.5 to 4 mm, alternatively from 0.6 to 2.5 mm, alternatively from 1.0 to 2.5 mm, in diameter. The diameter of the grinding beads affects the particle size distribution of the solid lubricant. The particle size distributions of solid lubricant can affect the performance of the AFC for load carrying capacity and product life time.

The grinding in (B) forms a dispersion of the solid lubricant (i) in the solvent (ii). The viscosity of the dispersion can vary, alternatively the viscosity is up to 5,000 mPa·s, alternatively the viscosity of the dispersion is from 5 to 5,000, alternatively from 20 mPa·s to 2500 mPa·s. Viscosity of the dispersion is measured using a Brookfield viscometer according to ASTM D1084 Method B.

A pre-dispersion of the solid lubricant (i) and the solvent (ii) can be made before the grinding in (B), alternatively (i) and (ii) may be combined and ground in (B) without the making of a pre-dispersion. The pre-dispersion may be made in the same vessel as the grinding in (B) or in a separate vessel. The pre-dispersion may be made with the dissolver 10 then the agitator basket 30 lowered into the pre-dispersion for grinding of the dispersion in (B) in the same vessel, alternatively the agitator basket 30 may be used to grind a combination of (i) and (ii), where (i) is not pre-dispersed in (ii). The pre-dispersion may be made using a separate dissolver disk which is replaced with a basket mill by the use of a quick-connector, where a dissolver disc is disconnected from the motor at the quick-connect connector and the basket mill connected using the quick-connect connector. One skilled in the art would know how to make a dispersion of the solid lubricant (i) and the solvent (ii) using the dissolver disc 10 of the basket mill, using a quick-connector to change a dissolver disc and the basket mill, or how to make a dispersion in a separate vessel before grinding in (B) with the basket mill, where separate dispersion equipment and basket mill are used to pre-disperse then grind the solid lubricant (i) in the solvent (ii).

The particle size and particle size distribution of the solid lubricant can be controlled by controlling the grinding time and the tip speed of the bead agitator. One skilled in the art would know how to modify the bead agitator tip speed and time to modify the particle size and particle size distribution. The time that the grinding (B) can be conducted may vary, alternatively the grinding (B) is conducted for up to 20 hours, alternatively from 5 minutes to 10 hours, alternatively from 5 minutes to 5 hours.

The rotation speed of the bead agitator can vary to modify the particle size and/or particle size distribution, alternatively the rotation speed of the bead agitator is up to 15,000 revolutions per minute (rpm), alternatively from 100 rpm to 6000 rpm, alternatively from 200 to 2000 rpm. One skilled in the art would know how to modify the rotational speed of the bead agitator.

The temperature of the method can vary. In one embodiment the method is conducted at ambient temperature, alternatively from 0° C. to 80° C., alternatively from 10° C. to 60° C., alternatively from 10° C. to 40° C.

The size of the dissolver disc can vary depending upon the size of the equipment. In one embodiment, the dissolver disc has a diameter up to 600 mm, alternatively from 150 mm to 450 mm, alternatively from 30 mm to 400 mm.

The solid lubricant in the dispersion after the grinding (B) has particle size (d90) of up to 75 μm and (d50) of up to 25 μm, alternatively a particle size (d90) from 15 μm to 35 μm and (d50) from 5 μm to 15 μm. As used herein, the particle size (d90) is particle size value at which the portion of particles with diameters below this value us 90%, and the particle size distribution (d50) is the particle size value at which the portion of particles with diameters below this value is 50%. One skilled in the art would know how to measure the particle size of the solids in a dispersion. Particle size is measured suing a Horiba LA-950 laser diffraction particle size distribution analyzer.

An antifriction coating composition prepared by the method of making an antifriction coating composition described above. The AFC composition can be applied to surfaces for all the reasons that an AFC composition is applied to a surface such as reduce friction, wear, and noise in many applications.

An antifriction coating, wherein the antifriction coating is prepared by making a film of the antifriction coating composition described above on a substrate and subjecting the antifriction coating composition to conditions to remove the solvent and form the antifriction coating, alternatively to conditions to cure the AFC composition to form the AFC.

An antifriction coating composition, comprising:

A dispersion of (i) a solid lubricant;

(ii) a solvent, (iii) a binder, and (iv) optionally, an additive, wherein the solid lubricant has a particle size (d90) up to 50 μm and (d50) of up to 25 μm.

The solid lubricant (i), the solvent (ii), the binder (iii), and the optional additive (iv) are as described above.

The particle size of the solid lubricant in the AFC is as described above. That is, the solid lubricant has a particle size (d90) up to 50 μm and (d50) of up to 25 μm, alternatively a particle size distribution (d90) from 15 μm to 35 μm and (d50) from 5 μm to 15 μm. Particle size and how to measure it are as described above for the method of making an AFC composition.

The AFC composition is made by the method of making an AFC composition described above.

A method of making an antifriction coating, comprising the steps of: applying the antifriction coating composition prepared as in the methods described above to a substrate and subjecting the applied antifriction coating composition to conditions to remove the solvent, alternatively to conditions to cure the AFC composition to form the AFC.

The AFC composition may be applied to a substrate by methods known in the art Examples of how the AFC composition can be applied include, but are not limited to, spraying, spin coating, brushing, dipping, and dip-spinning. One skilled in the art would know how to apply a AFC composition to a substrate.

The AFC composition is subjected to conditions sufficient to remove the solvent and/or cure the AFC composition, alternatively the AFC is subjected to elevated temperature, alternatively to a temperature from 10° C. to 280° C., alternatively to a temperature from 30° C. to 230° C., to remove the solvent and/or cure the AFC compositions to form the AFC. One skilled in the art would know how to cure the AFC composition to form an AFC. Alternatively, the AFC composition may include materials using different cure mechanisms such as humidity, ultraviolet radiation (UV) or infrared radiation (IR). One skilled in the art would know how to subject the AFC composition to elevated temperatures, humidity, UV or IR depending on the cure system used in the AFC. The AFC composition may also be subjected to sub-atmospheric pressure to remove the solvent. One skilled in the art would now how to subject the AFC composition to sub-atmospheric pressure.

The thickness of the antifriction coating may vary, alternatively the thickness of the AFC is from 2 μm to 50 μm, alternatively 5 μm to 20 μm. One skilled in the art would know how to coat a part to achieve these AFC thicknesses and would know how to measure coating thickness.

A part, comprising a sliding member coated with the antifriction coating composition prepared by a method described above.

A part, comprising a sliding member coated with the antifriction coating composition prepared by a method described above, where the AFC composition is cured.

The AFC composition is cured on the part by subjecting the part coated with AFC composition to conditions sufficient to cure the AFC composition. The conditions sufficient to cure the AFC composition are as described above for the method of preparing an antifriction coating.

The present invention is useful in providing an efficient process for making AFC compositions that reduces manufacturing times by using equipment that is easier to clean, that disperses and grinds solids in the same vessel, that is usable across multiple products or product families, and that requires replacement less frequently due to wear. Further, the present invention is useful in providing better control over the particle size distribution of the ground solids in AFC compositions, which produces AFC compositions having improved performance for load carrying capacity and product life time. The AFC composition are useful in coating parts to reduce friction, wear, and noise.

EXAMPLES

The following examples are included to demonstrate preferred embodiments of the invention, but they should not be considered as limiting the invention, which is delineated in the appended claims. It should be appreciated by those of skill in the art that the techniques disclosed in the examples which follow represent techniques discovered by the inventor to function well in the practice of the invention, and thus can be considered to constitute preferred modes for its practice. However, those of skill in the art should, considering the present disclosure, appreciate that many changes can be made in the specific embodiments which are disclosed and still obtain a like or similar result without departing from the spirit and scope of the invention. All percentages are in wt. % unless otherwise noted. The following table describes the abbreviations used in the examples.

TABLE 1

List of abbreviations used in the examples.

| Abbreviation | Word |
|---|---|
| g | gram |
| Me | methyl |
| wt | weight |
| % | percent |
| mol | mole |
| hr | hour |
| ° C. | degrees Celsius |
| NA | Not Applicable |
| mL | milliliters |
| Solids Content | (wt. of dried sample/wt. of initial sample) × 100 and determined as described below |
| cm | centimeter |

The formulation used in the examples to make antifriction coating compositions follows in Table 2:

TABLE 2

Formulation used in the Examples.

| Ingedient/trade name | Supplier | Wt. % |
|---|---|---|
| Hydrocarbon Fluid/Varasol | Exxon | 30.6 |
| n-butylacetate | Brenntag | 33.8 |
| Organoclay/Bentone | Elementix | 0.4 |
| Zinc 5-nitroisophthalate/Heucorin | Heubach | 1.2 |
| Antifloat additive/powdered antifloat agent | Lubrizol | 0.1 |
| Graphite | AMG Graphite | 4.8 |
| Molybdenum disulfide/MoS2 | Climax | 18.7 |
| Butyl titanate | Brenntag | 10.4 |
| | | 100 |

For Examples 1-1, 1-2, and 1-3, pre-dispersions were made by mixing a slurry sample with a 90 mm dissolver disc for 10 min at 700 rpm and additional 10 min at 600 rpm. The pre-dispersions were ground for the times, with the beads, range of bead sizes, basket fill volume, bead fill level and bead agitator speeds as specified below in Table 3. The basket mill used was from TML5 from VMA-Getzmann with 5 L vessel and 1.0-1.2 mm $ZrO_2$ beads were used.

For examples 2-1, 2-2, 2-3, 3-1, 3-2, and 3-3, a 320 kg slurry was stirred with a 250 mm dissolver disc for 30 min at 400 rpm. Next, the stirred slurry was filled in a 500 L double wall vessel and ground using the basket mill. The basket mill used for examples 2-1, 2-2, and 2-3 were different than for 3-1, 3-2, and 3-3. For 2-1, 2-2, and 2-3, a model TML250 basket mill from VMA-Getzmann was used, and a model TML500 from VMA-Getzmann was used for examples 3-1, 3-2, and 3-3. Both basket mills used 1.2-1.7 mm $ZrO_2$ beads.

The particle size results of the grinding of the pre-dispersions are listed in Table 4 below. Samples were taken at various times and particle size measured. using a Horiba LA-950 laser diffraction particle size distribution analyzer. Films were cast of the AFC compositions and Endurance/Lifetime testing of SRV EL-4 testing was performed according to ASTM D 5707 were run to determine the product endurance time.

All examples 1-X to 3-X, where X is 1, 2, or 3, were ground with the parameters Table 3. From each basket mill run, a sample was taken after a certain time (Table 3). All experiments were cooled by vessel and basket cooling during the grinding step. The comparative examples (320 kg) were ground in one pass using a common horizontal bead mill with a milling chamber of 15 L and 2.0 mm steal beads. Only the milling chamber was cooled.

TABLE 3

Grinding conditions and physical properties results of basket mill trials

| trial | grinding time [min] | $ZrO_2$ [mm] | basket fill vol [L] | beads fill level [%] | tool speed [rpm] |
|---|---|---|---|---|---|
| EXAMPLE 1-1 | 60 min | 1.0-1.2 | 0.11 | 60 | 2640 |
| EXAMPLE 1-2 | 90 min | 1.0-1.2 | 0.11 | 60 | 2640 |
| EXAMPLE 1-3 | 120 min | 1.0-1.2 | 0.11 | 60 | 2640 |
| EXAMPLE 2-1 | 150 min | 1.2-1.7 | 6.1 | 65 | 770 |
| EXAMPLE 2-2 | 180 min | 1.2-1.7 | 6.1 | 65 | 770 |
| EXAMPLE 2-3 | 210 min | 1.2-1.7 | 6.1 | 65 | 770 |
| EXAMPLE 3-1 | 120 min | 1.2-1.7 | 9.7 | 65 | 653 |
| EXAMPLE 3-2 | 150 min | 1.2-1.7 | 9.7 | 65 | 653 |
| EXAMPLE 3-3 | 180 min | 1.2-1.7 | 9.7 | 65 | 653 |
| COMPARATIVE EXAMPLE 1 | 180 min | 2.0 mm steel | 15 | | — |

TABLE 4

Particle size and endurance/life time (SRV EL-4 test) results of basket mill trials

| trial | grinding time [min] | $ZrO_2$ [mm] | Particle size d50 [μm] | Particle size d90 [μm] | Particle size mean value ± standard deviation [μm] | SRV EL-4 endurance/life time [hr] |
|---|---|---|---|---|---|---|
| EXAMPLE 1-1 | 60 min | 1.0-1.2 | 7.8 | 17.8 | 9.8 ± 7.5 | 4.4 |
| EXAMPLE 1-2 | 90 min | 1.0-1.2 | 7.6 | 17.5 | 9.7 ± 8.5 | 6.8 |
| EXAMPLE 1-3 | 120 min | 1.0-1.2 | 7.3 | 15.9 | 9.0 ± 7.0 | 7.8 |
| EXAMPLE 2-1 | 150 min | 1.2-1.7 | 9.2 | 45.5 | 17.6 ± 23.0 | 3.5 |
| EXAMPLE 2-2 | 180 min | 1.2-1.7 | 8.5 | 36.5 | 15.9 ± 23.1 | 6.0 |
| EXAMPLE 2-3 | 210 min | 1.2-1.7 | 8.2 | 23.6 | 12.5 ± 15.5 | 6.9 |
| EXAMPLE 3-1 | 120 min | 1.2-1.7 | 8.5 | 30.7 | 14.2 ± 18.2 | 4.5 |
| EXAMPLE 3-2 | 150 min | 1.2-1.7 | 8.4 | 33.1 | 15.1 ± 21.4 | 5.8 |
| EXAMPLE 3-3 | 180 min | 1.2-1.7 | 8.5 | 29.9 | 13.3 ± 14.6 | 7.2 |
| COMPARATIVE EXAMPLE 1 | 180 min | 2.0 mm steel | 8.5 | 22.9 | 12.5 ± 14.7 | 5.8 |

SRV EL-4 test was performed according ASTM D 5707: A constant load of 15 N (EL-4) was performed to prove the product endurance time. A frequency of 20 Hz and a stroke length of 1 mm is used.

TABLE 5

SRV LCC-4 200N (load carrying capacity) test results of basket mill trials.

| trial | grinding time [min] | $ZrO_2$ [mm] | max. running time [min] | max. test load [N] | surface pressure [N/mm$^2$] |
|---|---|---|---|---|---|
| EXAMPLE 1_1 | 60 min | 1.0-1.2 | 161 | 166 | 2576 |
| EXAMPLE 1_2 | 90 min | 1.0-1.2 | 156 | 161 | 2548 |
| EXAMPLE 1_3 | 120 min | 1.0-1.2 | 178 | 183 | 2661 |
| EXAMPLE 2_1 | 150 min | 1.2-1.7 | 130 | 135 | 2402 |
| EXAMPLE 2_2 | 180 min | 1.2-1.7 | 137 | 142 | 2440 |
| EXAMPLE 2_3 | 210 min | 1.2-1.7 | 155 | 160 | 2541 |
| EXAMPLE 3_1 | 120 min | 1.2-1.7 | 163 | 168 | 2576 |
| EXAMPLE 3_2 | 150 min | 1.2-1.7 | 134 | 139 | 2430 |
| EXAMPLE 3_3 | 180 min | 1.2-1.7 | 166 | 171 | 2599 |
| COMPARATIVE EXAMPLE 1 | 180 min | 2.0 mm steel | 139 | 144 | 2458 |

SRV LCC-4 200 N (load carrying capacity) test was performed according ASTM D 5706 Procedure B: In the load carrying capacity (LCC) test the load increases to a maximum of 200 N in 1N/min rate after holding 15 N for the first 10 min at a temperature of 50° C. A frequency of 20 Hz and a stroke length of 1 mm is used.

That which is claimed is:

1. A method of making an antifriction coating composition, comprising the steps of:

(A) combining (i) a solid lubricant, (ii) a solvent, (iii) a binder, and (iv) optionally, an additive; and (B) grinding the (i) solid lubricant in the solvent (ii) with a basket mill, wherein the basket mill comprises a container and an agitator basket comprising beads having a diameter from 1 to 2.5 mm, a bead agitator, a dissolver disc, and a drive shaft, wherein the bead agitator and the dissolver disc, are engaged with the drive shaft, to form a dispersion of the ground (i) solid lubricant in the (ii) solvent, wherein the dispersion has a viscosity from 20 mPa·s to 2500 mPa·s and the ground solid lubricant has a particle size (d90) of up to 75 μm and (d50) of up to 25 μm, wherein the grinding is done in a single step, (C) forming a pre-dispersion of the binder, the solid lubricant, the solvent, and the optional additives using a dissolver disc, then (D) conducting the grinding (B) of the pre-dispersion in the same container that the pre-dispersion was formed.

2. The method according to claim 1, further comprising: combining the binder (iii) with a second solvent (v) to form a mixture and combining the mixture with the solid lubricant (i) and the solvent (ii).

3. The method according to claim 1, further comprising modifying the grinding time to vary the average particle size and the particle size distribution of the solid lubricant.

4. The method according to claim 1, wherein the binder is a phenolic resin, epoxy resin, a silicone resin, or a mixture of two or more of a phenolic resin, epoxy resin, and a silicone resin.

5. The method according to claim 1, wherein the solid lubricant is graphite, $MoS_2$, PTFE, silicone, wax, a solid hydrocarbon wax, or a mixture of two or more of graphite, $MoS_2$, PTFE, silicone, wax, and a solid hydrocarbon wax.

6. The method according to claim 1, wherein the solvent is water, an alcohol comprising 1 to 4 carbon atoms, a ketone comprising 3 to 6 carbon atoms, an ester, a heterocyclic, an aliphatic or an aromatic compound.

7. The antifriction coating composition prepared by the method of claim 1.

8. An antifriction coating composition, comprising:

a dispersion of (i) a solid lubricant;

(ii) a solvent, (iii) a binder, and (iv) optionally, an additive, wherein the solid lubricant has a particle size (d90) up to 75 μm and (d50) of up to 50 μm and wherein the anti-friction coating composition is prepared according to the method of claim 1.

9. A method of making an antifriction coating, comprising the steps of: applying the antifriction coating composition prepared according to claim 8 to a substrate and removing the solvent.

10. A part, comprising a sliding member coated with the antifriction coating composition according to claim 8.

* * * * *